United States Patent [19]

Miller

[11] 4,068,875

[45] Jan. 17, 1978

[54] SECURITY LATCH FOR SLIDING DOORS

[75] Inventor: Nathaniel W. Miller, Hopewell, Va.

[73] Assignee: The Raymond Lee Organization, Inc., a part interest

[21] Appl. No.: 727,946

[22] Filed: Sept. 29, 1976

[51] Int. Cl.[2] ..... E05C 1/04

[52] U.S. Cl. ..... 292/206; 292/DIG. 9; 292/DIG. 46

[58] Field of Search ..... 292/DIG. 46, 281, DIG. 9, 292/206, 251, 251.5

[56] References Cited

U.S. PATENT DOCUMENTS

| | | | |
|---|---|---|---|
| 915,593 | 3/1909 | Greeno | 292/DIG. 9 |
| 922,644 | 5/1909 | Vogel | 292/206 |
| 926,460 | 6/1909 | Benedict | 292/DIG. 9 |
| 1,314,488 | 8/1919 | McMahan | 292/251 X |
| 1,371,087 | 3/1921 | Haslett | 292/281 |
| 1,715,590 | 6/1929 | Burhenne | 292/DIG. 9 |
| 1,727,977 | 9/1929 | Holtzman | 292/251 X |
| 2,003,128 | 5/1935 | Vasguey | 292/251 |
| 3,471,189 | 10/1969 | Ness | 292/251.5 |

FOREIGN PATENT DOCUMENTS

| | | | |
|---|---|---|---|
| 399,362 | 10/1933 | United Kingdom | 292/251 |

*Primary Examiner*—Richard E. Moore

[57] ABSTRACT

A latch for sliding doors, having a first plate fixed to the heel of one of the doors and a second plate hingedly attached to the end of the second plate. When the plates are folded together, they are parallel. When the plates are folded at right angles to each other, a screw threaded into the second plate engages a recess in the other door, preventing the doors from sliding relative to each other.

1 Claim, 3 Drawing Figures

SECURITY LATCH FOR SLIDING DOORS

SUMMARY OF THE INVENTION

In this invention, a recess is drilled into the side of one sliding door, while the invention is attached to the heel of the second sliding door. When the invention is latched, a plate with a screw projecting through it is swung parallel to the side of the door containing the recess, so that the screw end is introduced into the recess. Because the screw prevents one of the doors from moving with respect to the other, the doors are locked together until the screw is disengaged from the recess.

DETAILED DESCRIPTION OF PREFERRED EMBODIMENT

Figure 1:
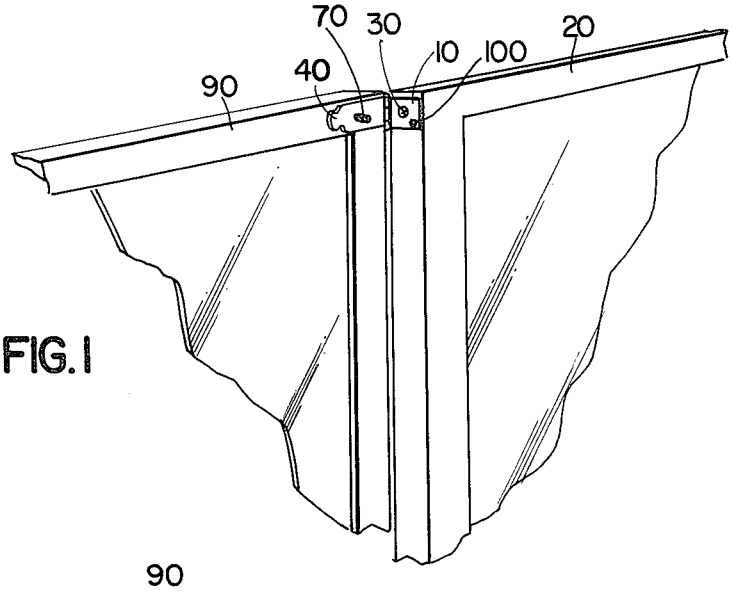
FIG. 1 shows the invention in use.

A first plate 10 is attached to the heel of door 20 by screw 30. A second plate 40 is attached to the end of plate 10 by hinge 50; when the plates are folded together, they are parallel, and when they are folded apart, they are perpendicular. The end of plate 40 remote from the hinge is curved so as to face towards the plate 10 when the plates are folded together, to enable plate 40 to be easily grasped. If desired, this curved portion may be shaped into a tab-like configuration 60.

Figure 2:
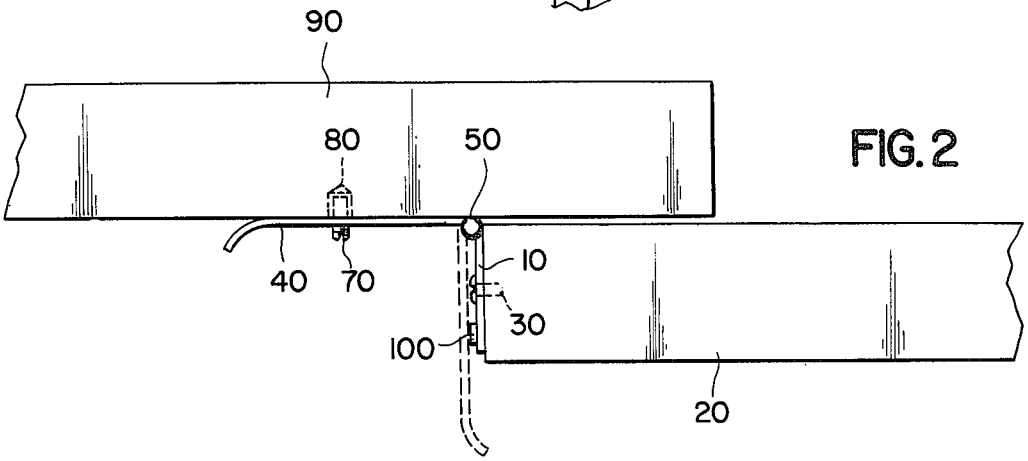
FIG. 2 shows a top view of the invention in use.
Figure 3:
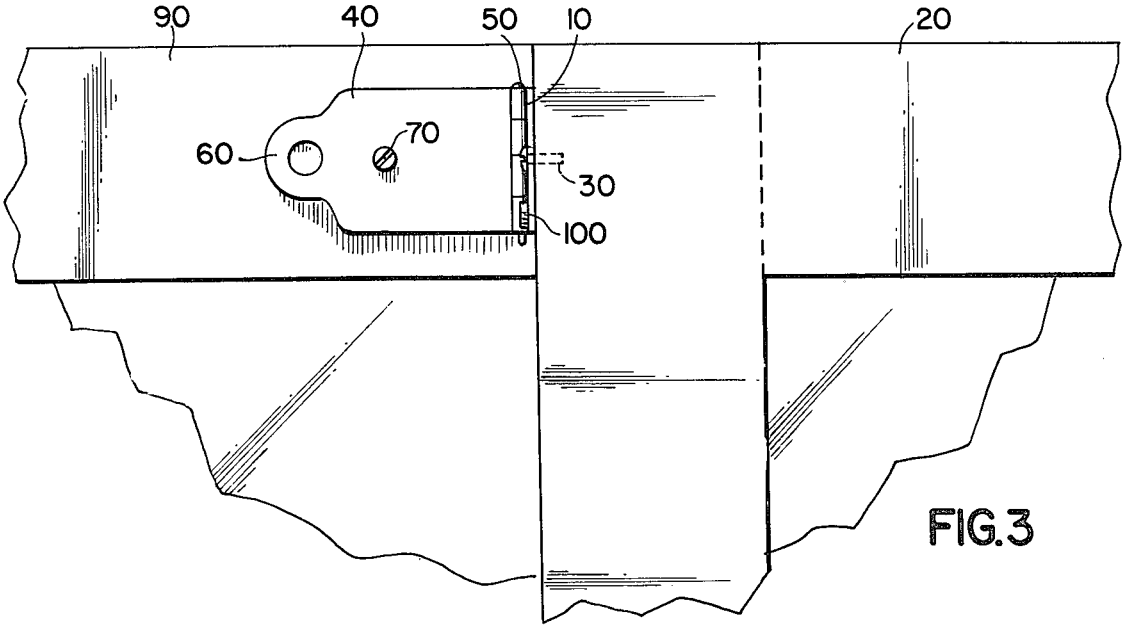
FIG. 3 shows a front view of the invention in use.

A screw 70 is threaded into a tapped hole in plate 40 so that the end of the screw without the head lies in recess 80 in the side of door 90 when the second plate is folded flat against door 90. When the screw so engages the recess, movement of either door relative to the other is impossible. Thus, in this position the doors are locked together. In order to unlock the doors, plate 40 can be swung to the position shown by dashed lines in FIG. 2. If desired, a torsion spring can be located at the hinge to press the plates away from each other, to keep the plate 40 in the locked position when it is set there.

To keep plate 40 parallel to plate 10 when the doors are to remain unlocked, a magnet 100 is attached to that face of plate 10 which is adjacent plate 40 when the plates are folded together. Since both plates are made of steel this magnet keeps plate 40 in the unlocked position until the device is deliberately set to lock the doors.

I claim:

1. A latch for sliding doors, comprising:

a first flat steel plate;

a second flat steel plate having one upwardly curving end;

a hinge connecting the two plates end to end so that the plates can be folded together parallel to each other or apart perpendicular to each other, with the curved end of the second plate being remote from the hinge and curving towards the first plate when the plates are folded together;

a threaded screw threaded through a threaded hole in the second plate, with the head of the screw projecting out of that side of the second plate which will be adjacent the first plate when the plates are folded together;

a magnet located on that side of the first plate which is adjacent the second plate when the plates are folded together; and a torsion spring located at the hinge and pressing the plates apart.

* * * * *